US006878244B2

(12) United States Patent
Sioli

(10) Patent No.: US 6,878,244 B2
(45) Date of Patent: Apr. 12, 2005

(54) FILTER-PRESS TYPE ELECTROCHEMICAL REACTOR WITH BUSH INSERTS

(75) Inventor: Giancarlo Sioli, Cernobbio (IT)

(73) Assignee: Casale Chemicals S.A., Lugano-Besso (CH)

( * ) Notice: Subject to any disclaimer, the term of this patent is extended or adjusted under 35 U.S.C. 154(b) by 138 days.

(21) Appl. No.: 10/152,798

(22) Filed: May 23, 2002

(65) Prior Publication Data

US 2002/0175072 A1 Nov. 28, 2002

(30) Foreign Application Priority Data

May 24, 2001 (EP) ..... 01112638

(51) Int. Cl.[7] ..... C25B 9/20
(52) U.S. Cl. ..... 204/258; 204/269; 204/275.1
(58) Field of Search ..... 204/269, 258, 204/275.1

(56) References Cited

U.S. PATENT DOCUMENTS

| | | | | |
|---|---|---|---|---|
| 2,717,872 A | | 9/1955 | Zdansky et al. | |
| 4,076,609 A | * | 2/1978 | Mas | 204/258 |
| 4,274,939 A | | 6/1981 | Bjareklint | |
| 4,451,347 A | * | 5/1984 | Wullenweber | 204/258 |
| 4,722,789 A | * | 2/1988 | Kupka | 210/225 |
| 4,758,322 A | | 7/1988 | Sioli | |
| 6,117,287 A | | 9/2000 | Molter et al. | |

* cited by examiner

*Primary Examiner*—Roy King
*Assistant Examiner*—Harry D. Wilkins, III
(74) *Attorney, Agent, or Firm*—Sughrue Mion, PLLC

(57) ABSTRACT

A Kit of modular components for the manufacture of an electrochemical reactor (1) of the so-called filter-press type having a substantially tubular body (1*a*), closed at the opposite ends by end plates (2, 3) and in which is defined a sequence of electrolyte cells (4*z*, 4*b*) in fluid with pipes (7 to 10) extended in said body (1*a*), in a direction parallel to its axis (AA), for the collection and distribution of process fluids, distinguishes itself in that it comprises: a plurality of electrochemically functional flat elements (13, 13*a*) selected from bipolar elements and separation elements, a plurality of frames (11), all identical to each other, realized with an electrically non-conducting material and structured to enclose and support inside them, in a per se known way, respective pre-selected electrochemically functional flat elements (13, 13*a*), each of the frames (11) being equipped with an equal plurality of through-holes (14, 14*a*; 15, 15*a*; 211, 22; 26, 27) parallel to the axis of the respective frame (11) and equally angularly arranged between consecutive frames, each through-hole (14, 14*a*; 15, 15*a*; 21, 22; 26, 27) being in fluid communication with the inside of the frame (11) through at least one passage (16 to 19) extended in the respective frame (11) in a substantially radial direction; a plurality of cylindrical bush inserts (25), obtained with an electrically non-conducting material, capable of being coaxially engaged in each of the through-holes (14, 14*a*; 15, 15*a*; 21, 22; 26, 27) in a pressurized fluid-tight arrangement, to hermetically close such at least one fluid communication passage (16 to 19) between the hole and the inside of the respective frame (11).

5 Claims, 11 Drawing Sheets

FILTER-PRESS TYPE ELECTROCHEMICAL REACTOR WITH BUSH INSERTS

FIELD OF APPLICATION

The present invention refers, in its most general aspect, to an electrochemical reactor of the type which has a filter-press configuration comprising, in the form of a pack, a plurality of electrolytic cells juxtaposed in pressurized fluid-tight sealing and in fluid communication with one or more "main" pipes for feeding respective operating fluids and for removing the products of the electrochemical reaction.

In the aforementioned filter-press configuration, the electrolytic cells are defined between and mutually separated by "bipolar components". Each bipolar component basically comprises an annular frame, preferably but not exclusively circular, made of electrically non-conducting material and a bipolar element, generally in the form of a flat plate of electrically conductive material, framed and supported by said annular frame.

Said bipolar element, or bipolar electrode, is a so-called conductor of the first kind, generally obtained in a highly conductive metal or in graphite, in which the conduction takes place through the free electrons.

Inside each of the electrolytic cells, in a position located between the two bipolar components which border said cell, there is generally provided a "separation component". The separation component basically comprises an annular frame made of electrically non-conducting material and a separation element, for example a microporous membrane or a porous diaphragm, in their nature electrically non-conducting, framed and supported by said annular frame.

Such a separation element becomes electrically conductive only in the presence of an electrolyte or of water, which fills its pores; in this condition it is considered to be a so-called conductor of the second kind, in which the conduction takes place through the ions.

Said separation component subdivides the respective electrolytic cell into two contiguous electrode compartments, i.e. anodic and cathodic.

In the following description and in the subsequent claims, the aforementioned bipolar and separation components will also be referred to as functional components.

Therefore, in its basic form an electrochemical reactor, to which the present invention refers, is made up of a double plurality of functional components, i.e. bipolar and separators. The components are juxtaposed in a filter-press configuration, where the totality of the respective annular frames, mutually bunched together in pack arrangement and in pressurized fluid-tight sealing, constitutes the tubular body of said reactor.

In a more particular aspect, this invention refers to a functional component, bipolar or separator, for the manufacture and the operation of electrochemical reactors of the aforementioned type.

Depending upon the electrochemical process which one intends to carry out, each electrode compartment of the electrolyte cells, which constitute the designed electrochemical reactor, is in fluid communication, through one or more passages formed on the annular frames of the functional components of each cell, with the collectors for the collection and distribution of gases and liquids, outside the reactor.

PRIOR ART

In the patent U.S. Pat. No. 4,758,322, here included for reference, an electrochemical reactor with a filter-press configuration of the type considered above is described, in which the main pipes for the collection and distribution of fluids are formed in the body itself of the reactor and are extended parallel to its axis.

For such a purpose, the annular frames of the bipolar and separation components of each electrolyte cell are crossed, in a direction parallel to the axis of the reactor, by an equal number of identical through-holes (in particular, three or four holes), provided in the same mutually angular position.

When the functional components (bipolar and separators), associated in the desired filter-press configuration, are fixed together in the form of a pack, the through-holes which correspond to one another in the different respective annular frames of said components, are axially aligned to constitute the mentioned main fluid collection and distribution pipes.

At each electrolyte cell, the main pipes are in fluid communication with a pre-selected electrode compartment of the cell, through passages made up of grooves formed tangentially in the thickness of the frames of the functional components that border said compartment. The grooves of a frame are positioned differently and orientated differently with respect to those of the contiguous frames.

Thus, in the state of the art, the two pluralities of functional components (bipolar and separators) are also differentiated by their different structuring of the annular frames, in addition to the different nature of the functional elements supported by said frames.

Although they are recognized to be advantageous from many points of view, the prior art electrochemical reactors, structured in the aforementioned way, present some drawbacks which, up to now, have not been overcome.

In particular, one functional drawback is constituted by the fact that the use of a double plurality of components, bipolar and separators, each with its own annular frame and with its own respective arrangement of through-holes and tangential grooves, limits the realisation of electrochemical reactors to those in which every single cell is made up of two electrode compartments, each equipped with an entry and an exit for the fluids.

Typical processes carried out electrochemical reactors having such a configuration are the production of sodium carbonate (soda)—chlorine, the electrolysis of water and hydrochloric acid, redox batteries, and air/hydrogen fuel cells without internal cooling.

Another structural and logistical drawback, is that for each of the electrochemical processes of the type mentioned above (amongst the many processes now in use), it is necessary to use (and thus have them stored) a high quantity of bipolar and separation components tailor-made for that use. And this is particularly relevant to the annular frames of such components.

SUMMARY OF THE INVENTION

The problem underlying the present invention is that of providing an electrochemical reactor with a filter-press configuration as considered above made from functional components which have structural and functional features that will overcome the drawbacks mentioned with reference to the prior art. That is to say features that make it possible to use them for the manufacture of an electrochemical reactor independently from the number (two, three or more) of electrode compartments foreseen for the electrolyte cells thereof and, simultaneously, with a substantial simplification both in the structure and the operation with respect to what has been possible up to now with the prior art.

This problem is solved according to the present invention by a kit of modular components for the manufacture of an electrochemical reactor of the so-called filter-press type having a substantially tubular body, closed at the opposite ends by end plates and in which is defined a sequence of electrolyte cells in fluid communication with pipes extended in said body, in a direction parallel to its axis, for the collection and distribution of process fluids, said kit of components is characterized in that it comprises:

a plurality of electrochemically functional flat elements selected from bipolar elements and separation elements, a plurality of frames, all identical to each other, realised with an electrically non-conducting material and structured to enclose and support inside them, in a per se known way, respective pre-selected electrochemically functional flat elements, each of said frames being equipped with an equal plurality of through-holes parallel to the axis of the respective frame and equally angularly arranged between consecutive frames, each through-hole being in fluid communication with the inside of said frame through at least one passage extended in the respective frame in a substantially radial direction, a plurality of cylindrical bush inserts, obtained with an electrically non-conducting material, capable of being coaxially engaged in each of said through-holes in a pressurized fluid-tight arrangement, to hermetically close said at least one fluid communication passage between said hole and the inside of the respective frame.

The use of identical frames solves the general problem, while the task of setting up the electrochemical process is left to the cylindrical bush inserts which, appropriately engaged in the pre-selected through-holes of the annular frames, carry out the function of flow directing bushes.

Each electrochemical reactor is basically made up of a sequence of electrode compartments whose walls are in turn made up of electrochemically functional elements of various nature: metallic plates, porous polymeric membranes, ionically active membranes, porous diaphragms, graphite plates, etc.

Each functional element is supported and kept in position by an annular frame; -there are so many reactor compartments as are the annular frames.

Each frame is equipped with an inlet and an outlet for gaseous-liquid fluid, or a gaseous-liquid mixture.

To which main-pipe such fluids flow, is decided by the bush inserts.

The features and the advantages of the invention will become clearer from the following description of some indicative and non-limiting embodiments of a kit for electrochemical reactors according to the invention, made with reference to the attached drawings.

DETAILED DESCRIPTION OF A PREFERRED EMBODIMENT

Figure 1:
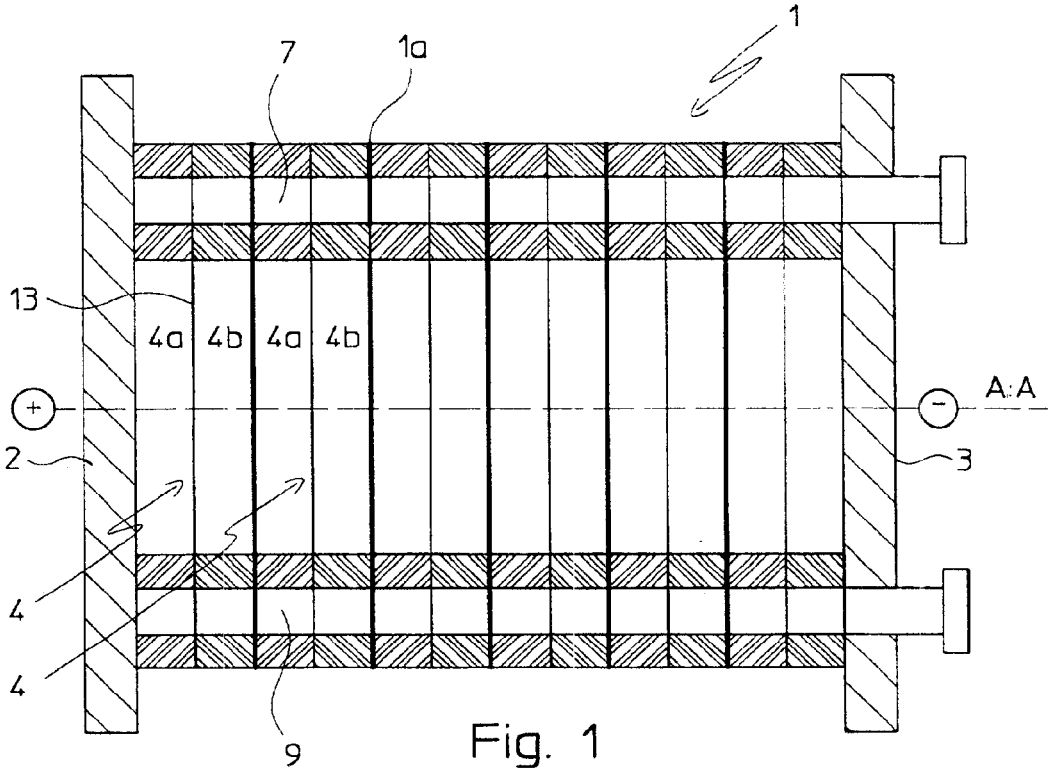
FIG. 1 shows schematically a filter-press electrochemical reactor, with electrolyte cells with two electrode compartments.

With reference to FIG. 1, an electrochemical reactor with a so-called filter-press configuration is indicated with reference number 1. Said reactor 1 has a tubular body la, preferably but not exclusively cylindrical, closed at opposite ends by electrically conducting or electrically insulating end plates 2, 3, which are however passed through by electrical conductors linked to the internal conducting parts of the reactor.

In the body 1*a*, whose longitudinal axis is indicated with AA, a sequence of electrolyte cells 4 is defined, which—in this specific example—are of the type with two electrode compartments 4*a*, 4*b*, due to the presence in each of these of a separation functional component 5.

The electrolyte cells 4 are contained and mutually separated by bipolar functional components 6, or else by end covers or end plates like 2 and 3.

The electrolyte reactor 1 of the example in FIG. 1, has a body 1*a* basically formed of a sequence of bipolar components 6 and separation components 5, alternating in a pack (or filter-press) arrangement.

The electrolyte cells 4 are in fluid communication in the way described hereinbelow with the main pipes 7, 8, 9, 10 (in FIG. 1 only pipes 7, 9 can be seen). Main pipes 7, 8, 9, 10 extend along the body 1*a* of the reactor 1, in parallel with its axis AA, and are used for the distribution and collection of the fluids involved in an electrolytic process carried out inside the reactor 1.

Figure 2:
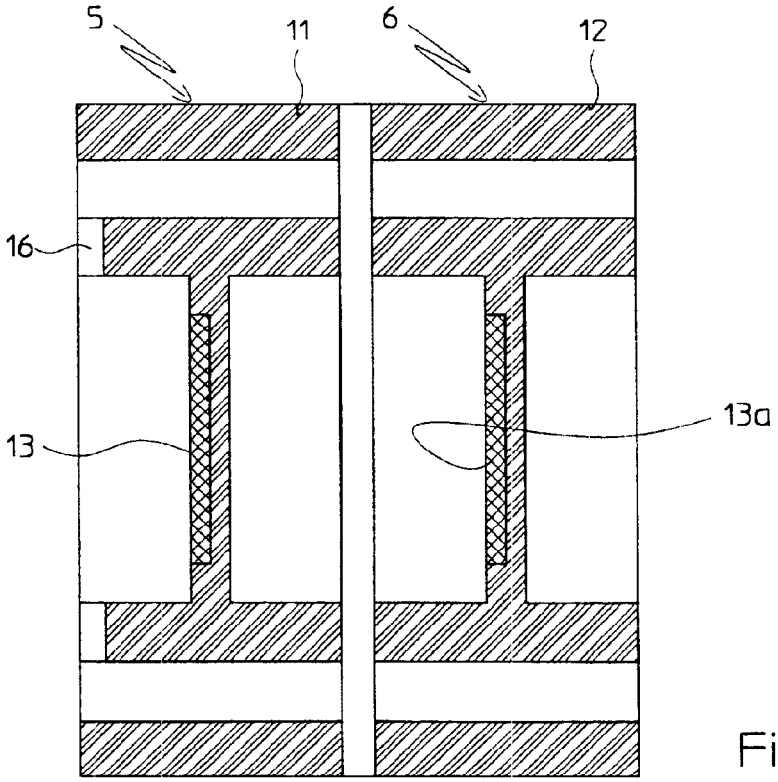
FIG. 2 shows an enlargement of a detail of FIG. 1.

With reference to FIG. 2, the separation and bipolar components 5, 6 comprise an annular frame 11, 12 (circular, in the example in FIG. 2), made from an electrically non-conducting material, and a separation functional element 13 and a bipolar functional element 13*a*, respectively, framed and supported inside the respective frames 11, 12.

The separation element 13 is made up, for example, of a microporous membrane, which is per se electrically non-conducting, while the bipolar element 13*a* is made up of a plate of graphite or another appropriate electrically conducting material.

Figure 3:
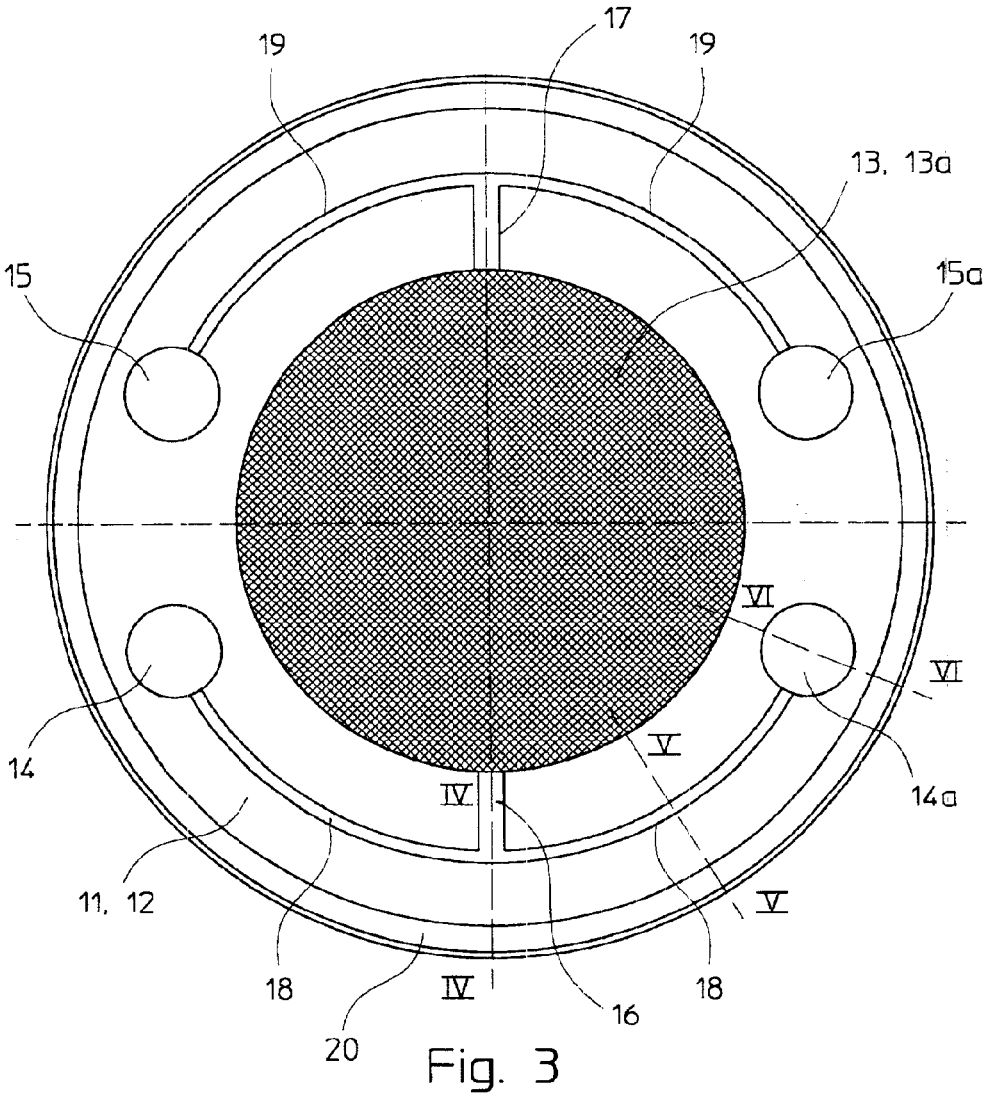
FIG. 3 shows an enlargement of a component of the kit according to the invention, which is useful for the manufacture of a filter-press electrochemical reactor.
Figure 4:
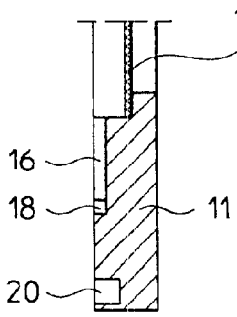
FIGS. 4, 5 and 6 show sections made along the lines IV—IV, V—V, VI—VI of FIG. 3, respectively.
Figure 5:
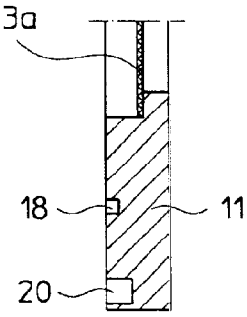
Figure 6:
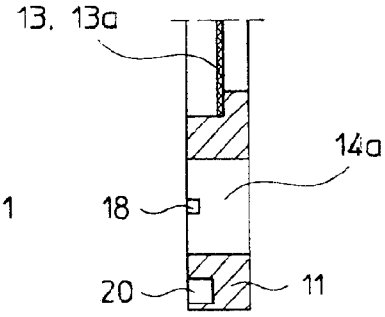

According to the present invention (FIGS. 3, 4, 5) all frames 11, both of the separation components 5 and of the bipolar components 6, are identical and are equipped with an equal number (four, in the case illustrated) of through-holes 14, 14*a*, 15, 15*a*, having axes parallel to the axis of the respective annular frame 11. Also, in all the consecutive frames 11, said holes 14, 15 have an equal angular arrangement.

When a pre-selected plurality of frames 11 is fixed in pack arrangement to make up the body la of an electrochemical reactor 1, the through-holes 14, 14*a*, 15, 15*a*, which correspond with each other in said frames, constitute the main pipes (7 to 10), cited above, for the distribution into and the collection from each electrode compartment 4*a*, 4*b* of the reactor itself, respectively.

To this end, and still according to the present invention, all the through-holes 14, 14*a*, 15, 15*a* of each frame 11, are in fluid communication with the inside of the respective frame. In the example of FIGS. 3 to 6, said communication is obtained through passages consisting of radial 16, 17 and circumferential 18, 19 grooves, formed on the front of said frame 11 and opened both onto said holes and the inside the frame itself.

A circular groove 20, is perimetrically provided in each frame 11 and on one side only of it, to receive an appropriate fluid-tight gasket, such as an O RING, between two consecutive frames in the filter-press arrangement of the corresponding reactor 1.

Figure 7:
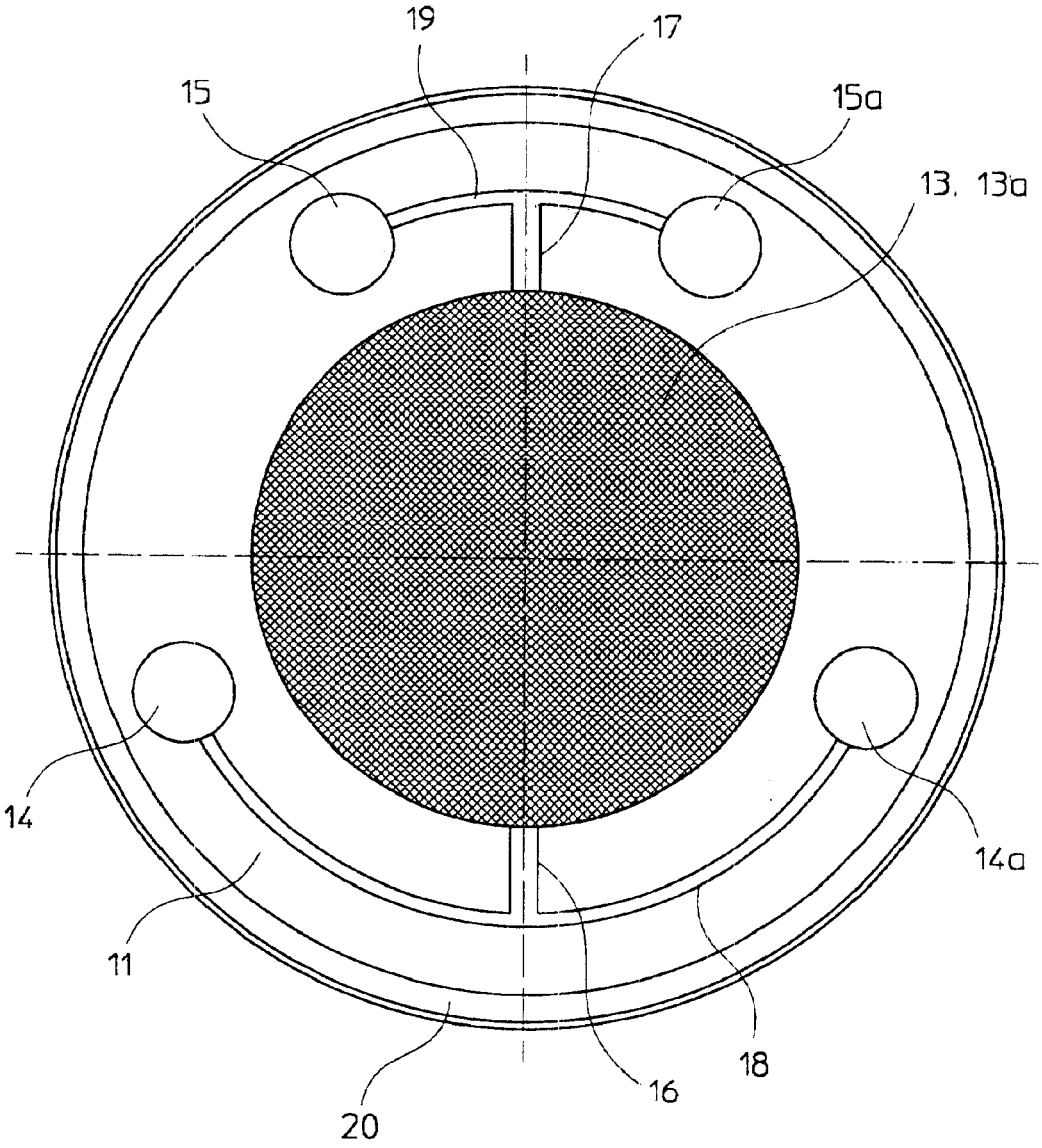
FIGS. 7 to 10 show alternative embodiments of the component in FIG. 3.
Figure 8:
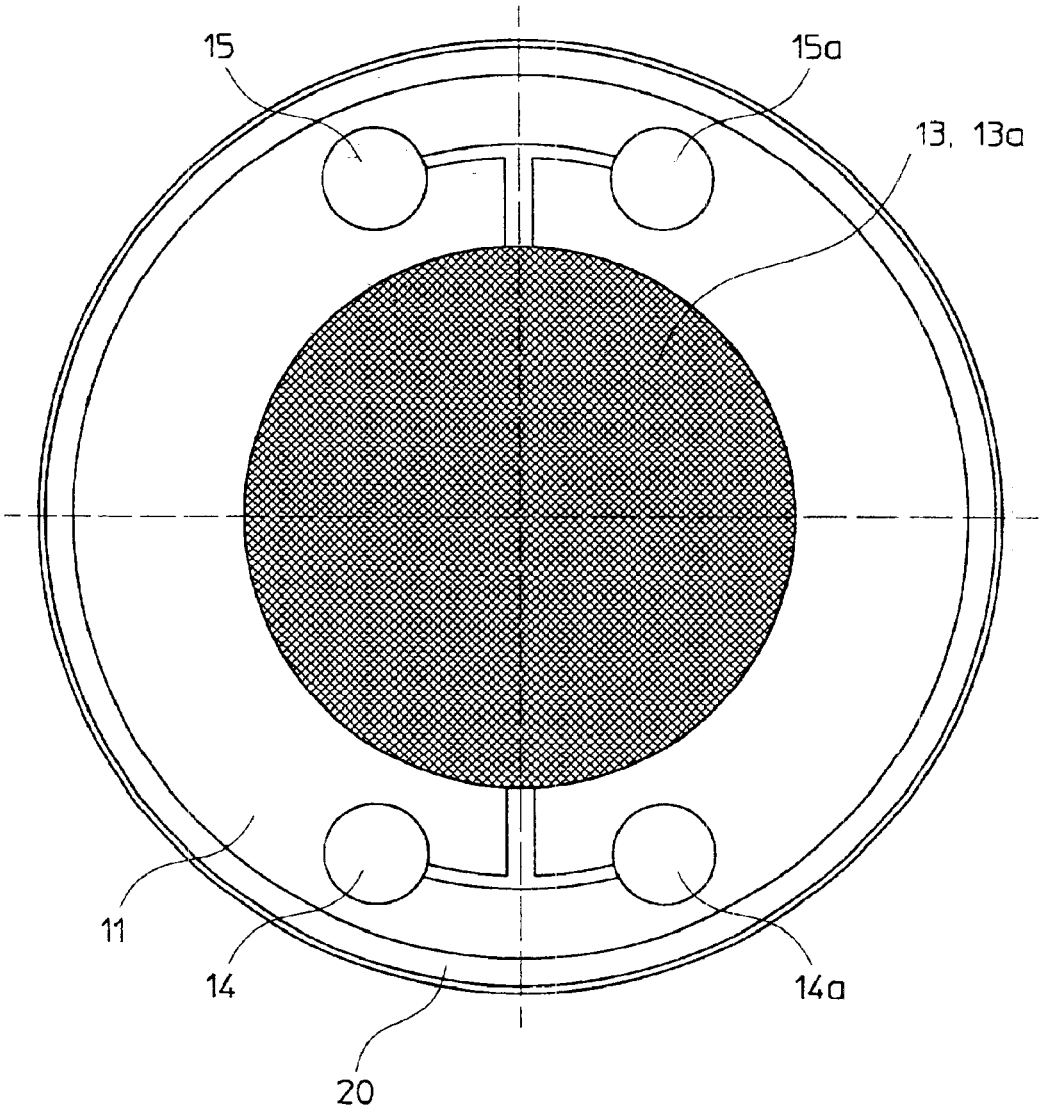

In FIGS. 7, 8 alternative embodiments of the aforementioned annular frames 11 are shown, with different arrangements of through-holes 14, 14*a*, 15, 15*a*.

Figure 9:
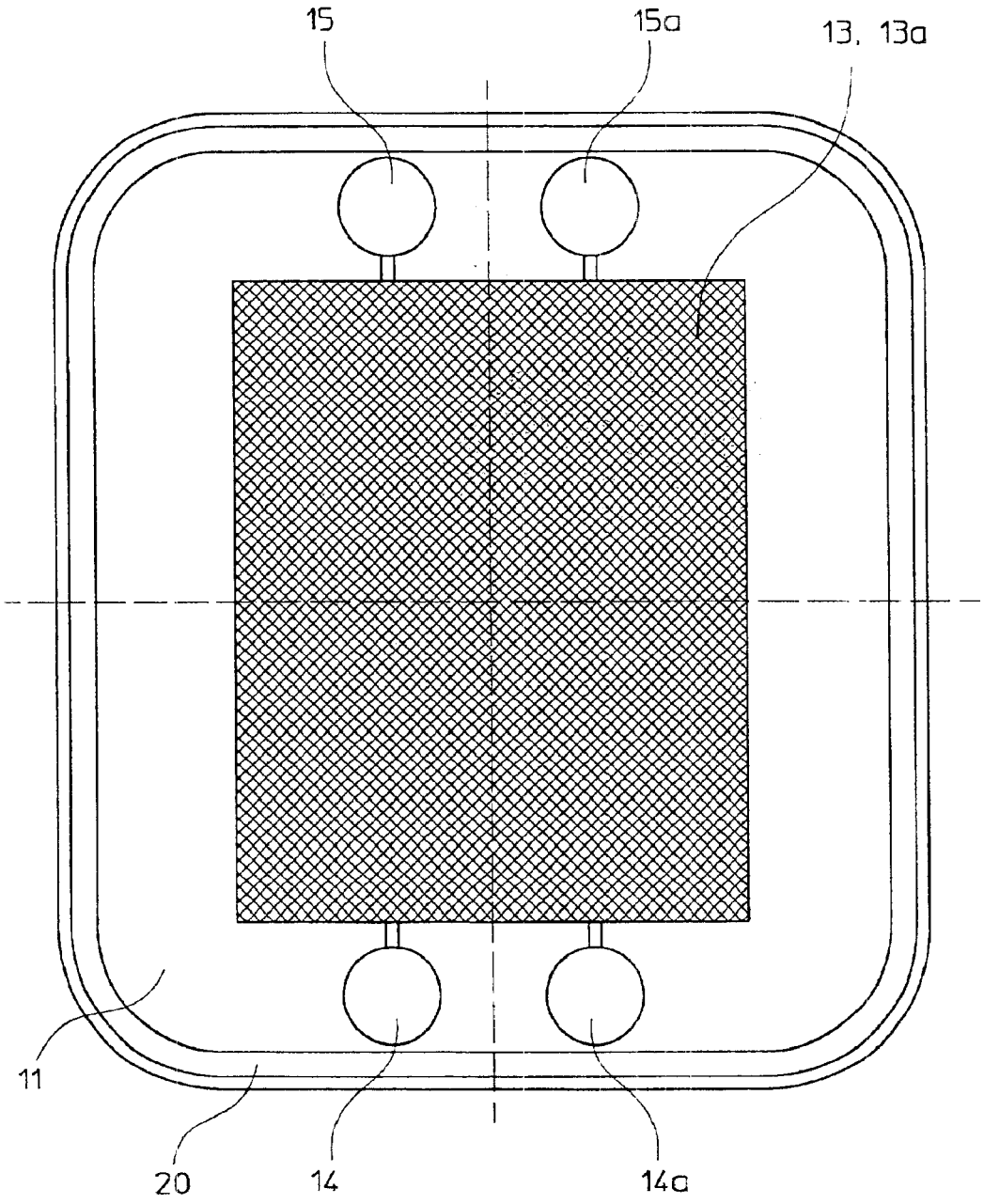

According to the embodiment in FIG. 9, the frames 11 have a basically quadrilateral, rather than circular form.

Figure 10:
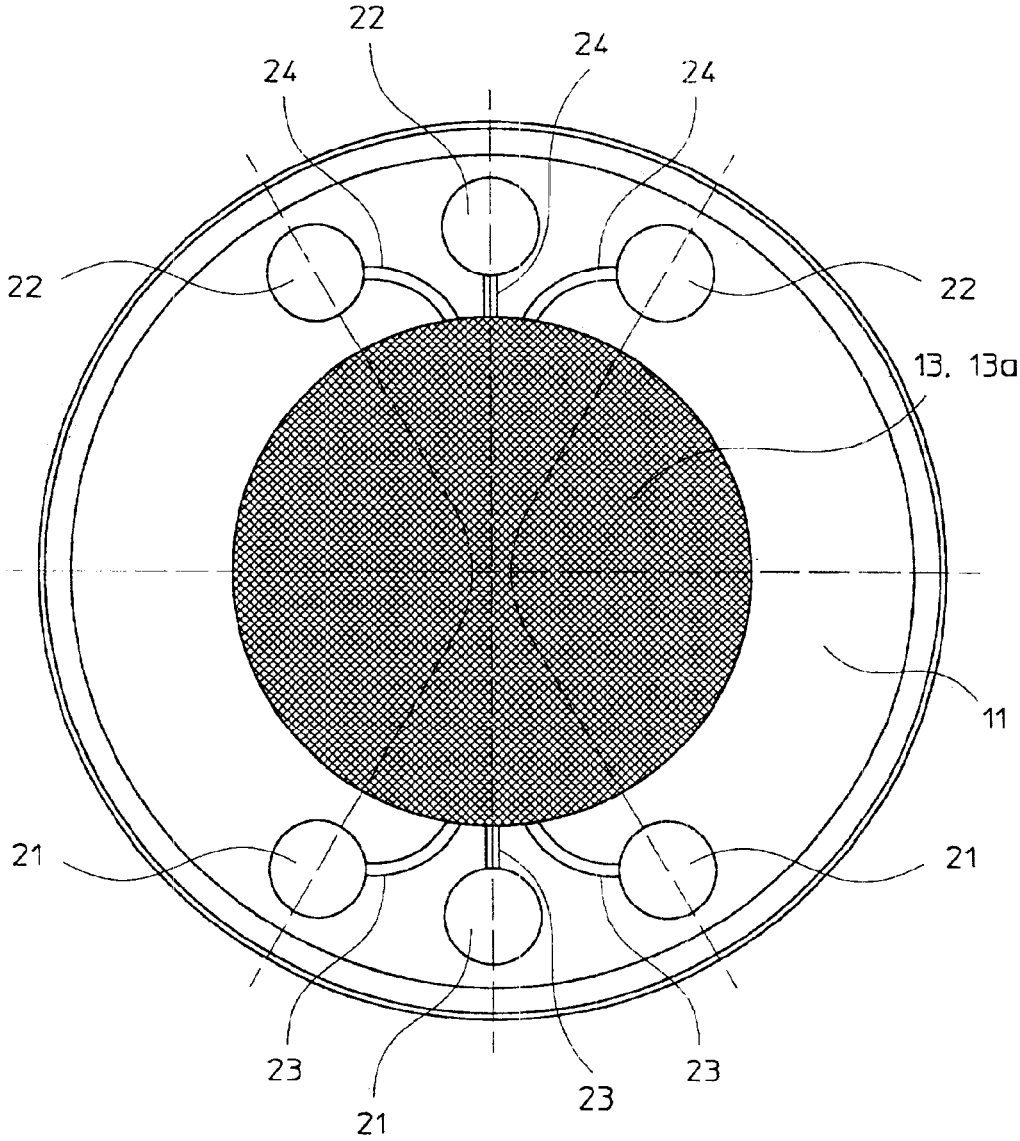

In the embodiment in FIG. 10, each frame 11 is equipped with six through-holes, of which those for fluid distribution are indicated with 21, while those for fluid collecting are indicated with 22. Each hole 21, 22 is in fluid communication with the inside of the respective annular frame 11, through at least one passage 23, 24, formed in the frame itself. The frames in this embodiment allow an increase (from four to six) of the main fluid pipes that can participate in the electrochemical process, as well as in the manufacture of electrolyte cells with three electrode compartments.

Figure 11:
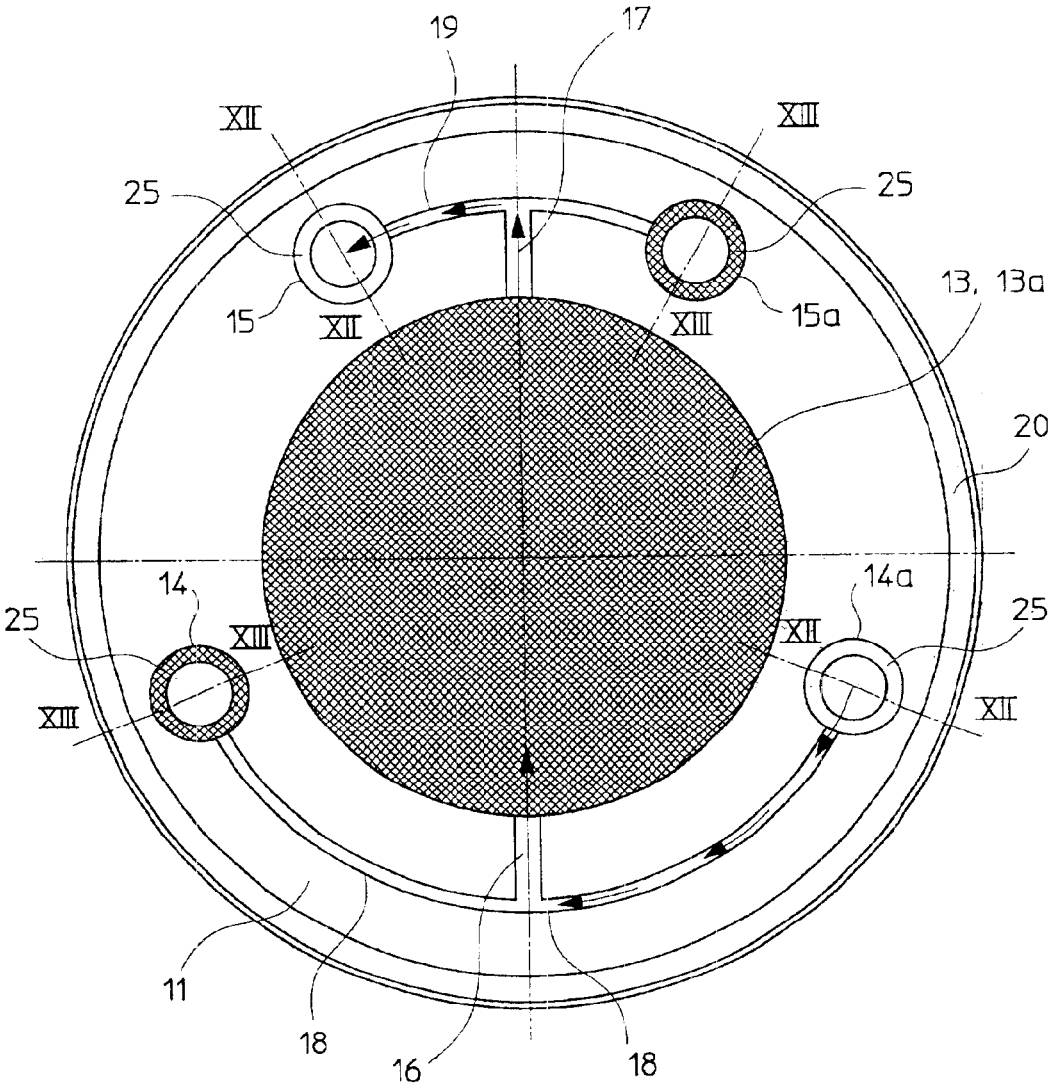
FIG. 11 shows a second component of the kit of the present invention associated with the component of FIG. 7.
Figure 12:
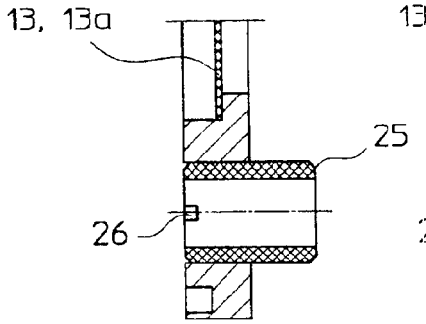
FIG. 12 and 13 represent sections made along the lines, XII—XII and XIII—XIII in FIG. 11.
Figure 13:
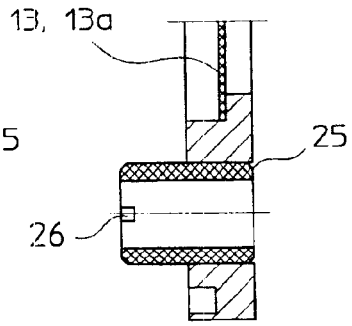

With reference to FIGS. 11 to 13, the kit of the present invention comprises a second fundamental component, made up of a cylindrical bush insert 25, which in the following description will simply be referred to as: bush.

Said bush 25 is equipped with a radial fluid passage 26 that, in the embodiment shown in figures 11 to 13, is made up of a slit formed at one end of it. The slit 26 has equal dimensions to those of the grooves 18, 19 or 23, 24, cited above.

Bushes 25 are intended for being engaged, in a pressurized fluid-tight arrangement, in the through-holes 14, 14*a*, 15, 15*a* (or 21, 22) of the annular frames 11, with the purpose of stopping or ensuring their hydraulic connection with the inside of the respective frame. Therefore, through the bushes 25 it is possible to connect the single compartments of electrolyte cells of a reactor, with pre-selected main fluid distribution and collection pipes.

In particular, bushes 25 are inserted into through-holes 14, 14*a*, 15, 15*a*, as shown in FIGS. 12, 13. In FIG. 12, the bushes 25 in the holes 14*a*, 15 are positioned so that the respective slits 26 open out onto the grooves 18, 19, while (FIG. 13) those inserted in the holes 14, 15*a* are positioned so that they close off the communication between said holes and the grooves and, thus, between said holes and the inside of the respective frame 11. The result is that the fluid that flows inside the hole 14*a*, or rather in the bush 25 fitted into said hole, is directed inside the frame 11, while no fluid comes out from the hole 14, or rather from the bush fitted into it. Conversely, the fluid that flows inside the frame 11 arrives at the hole 15, while it is blocked towards the hole 15*a*.

An electrolyte reactor with an alternating bipolar and separation component arrangement (two electrode compartment electrolyte cells) and with the arrangement of the bushes 25 in the holes of the frames 11 of said components, as described above, is characteristic, for example, of the production of chlorine and caustic soda through electrolysis of sodium chloride, or else of the production of energy in Vanadium redox batteries.

Figure 14:
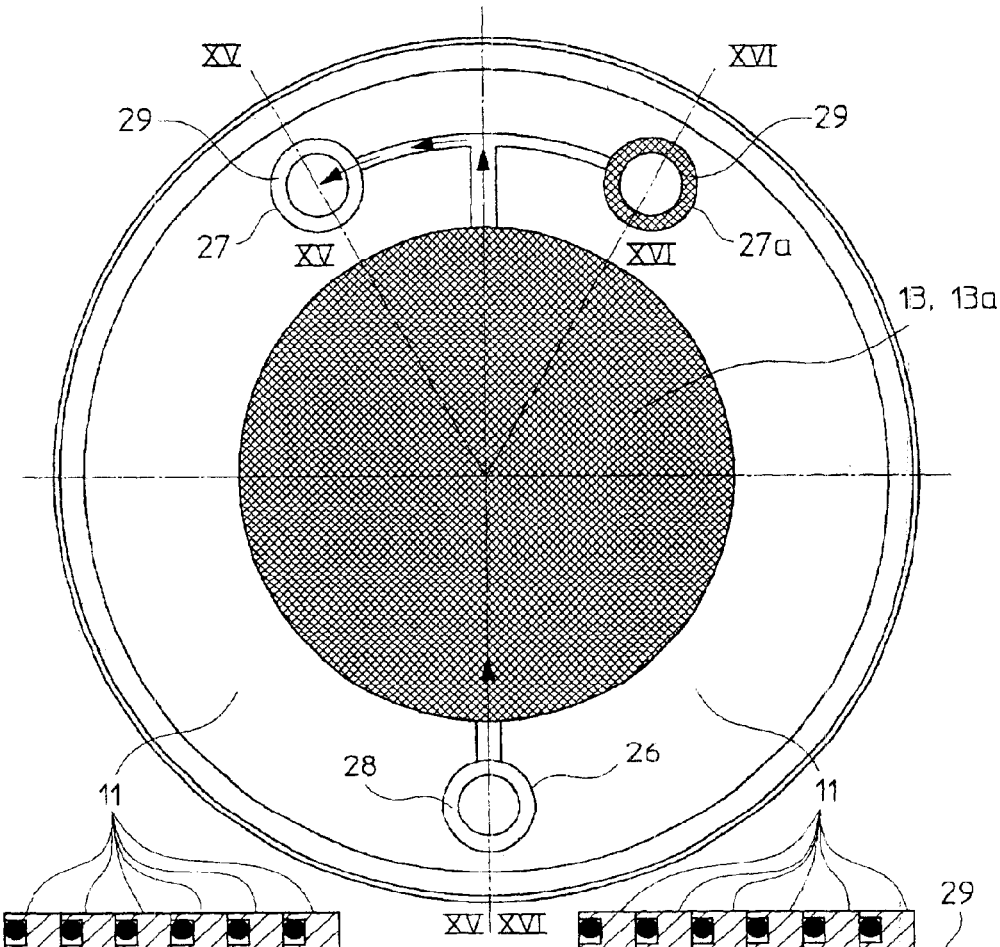
FIGS. 14 to 22 show schematically some examples of application of the kit of components according to the invention.
Figure 15:
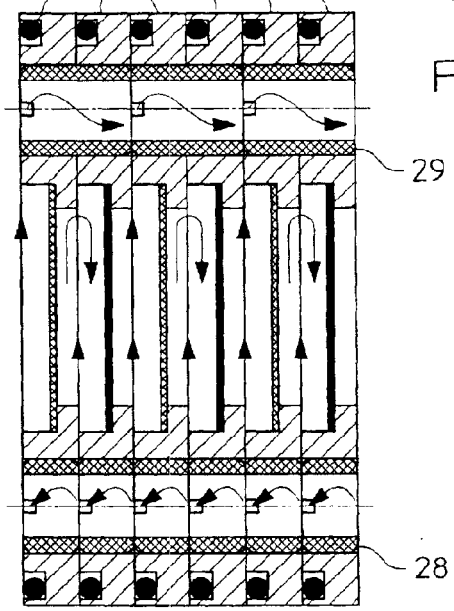
Figure 16:
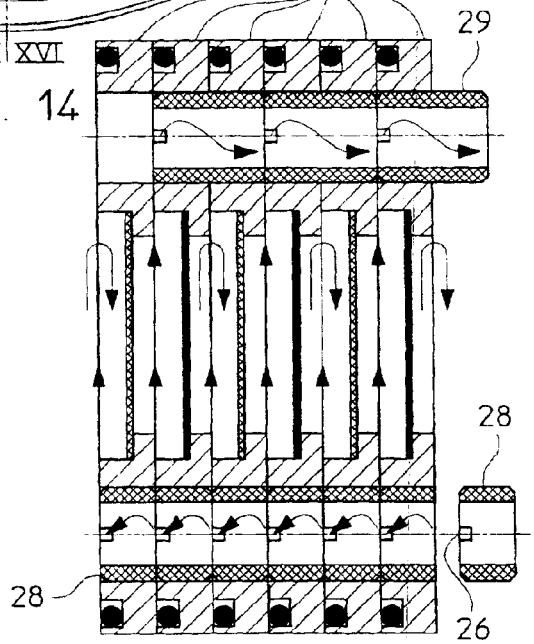

FIGS. 14 to 16 show the particular case of two-compartment electrolyte cells, i.e. anodic and cathodic compartments, in which a single electrolyte is fed, like in the process of water electrolysis, whilst the products of the electrolysis (hydrogen and oxygen) are collected separately.

The filter-press configuration of the respective electrochemical reactor is achieved using annular frames 11 which have three through-holes 26, 27, 27*a*. The holes 26 intended to constitute the main distribution pipe, are engaged by bushes 28 that have a length equal to the thickness of the respective frame. The holes 27, 27*a*, intended to constitute the main gas collection pipes, are engaged by respective bushes 29 that have a length which is double the thickness of the frame 11.

Figure 17:
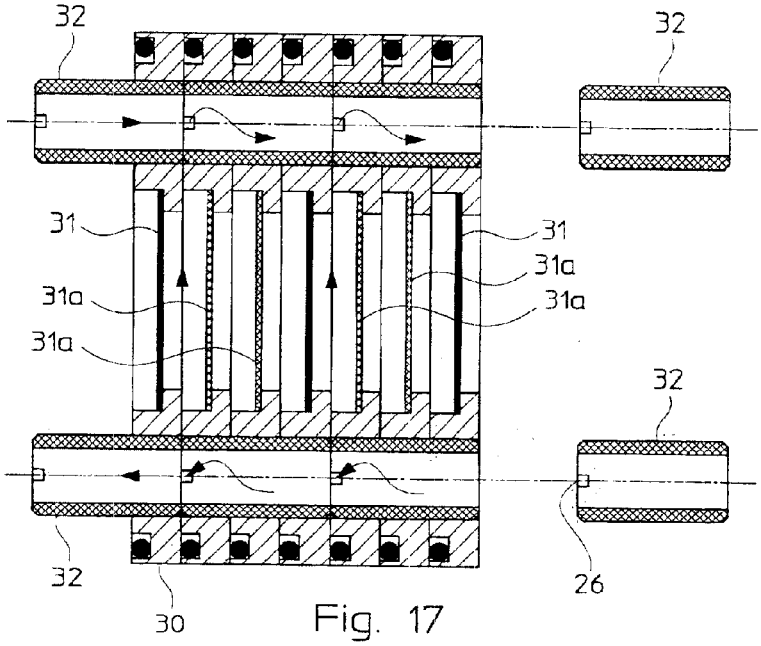
Figure 18:
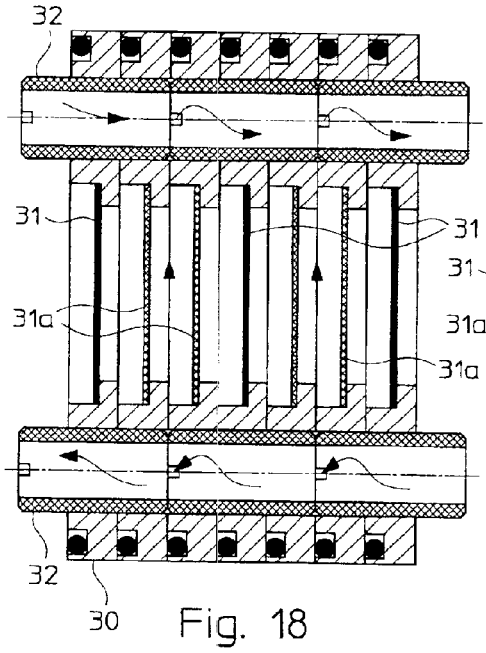
Figure 19:
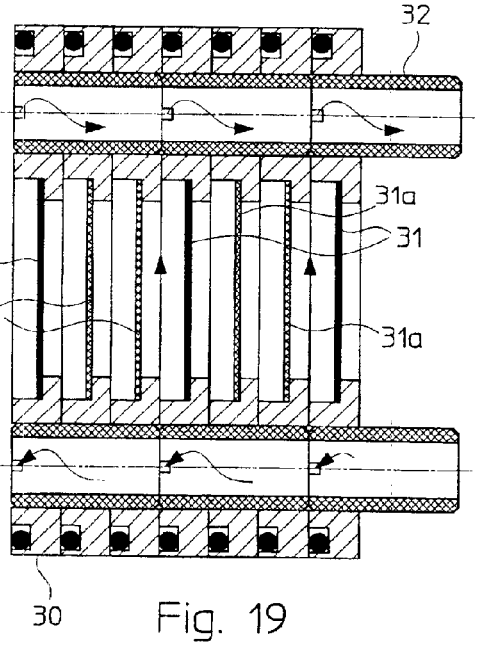

FIGS. 17 to 19 show the case of electrolyte cells with three electrode compartments for carrying out a process like for example electrodialysis of a salt, in which three different liquids circulate. The filter-press configuration of the electrochemical reactor is achieved using annular frames 30, equipped with six through-holes. In particular, the frames 30 that support bipolar elements 31 border every single cell of said reactor, while the frames 30 that support respective separation elements 31*a* (ionic membranes) define the pre-selected compartments in each cell.

The salt solution to be submitted to electrodialysis, is fed in the compartments between the membranes 31*a*, through which migrate the ions in solution forming an anolyte and a catholyte, respectively, which are collected separately. In this case, the distribution and collection of the process liquids is achieved through the use of bushes 32, which have a length equal to three times the thickness of the respective annular frames 30.

Figure 20:
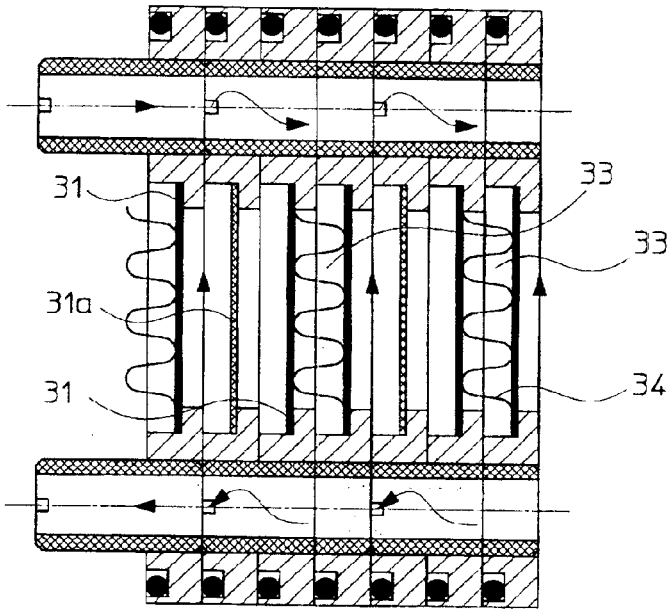
Figure 21:
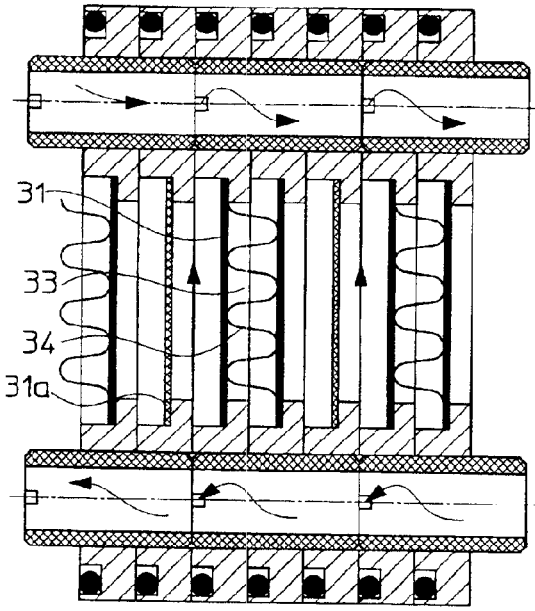
Figure 22:
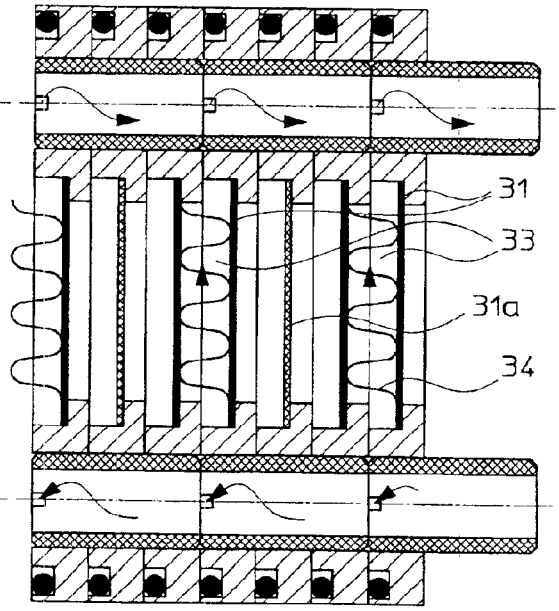
Figure 23:
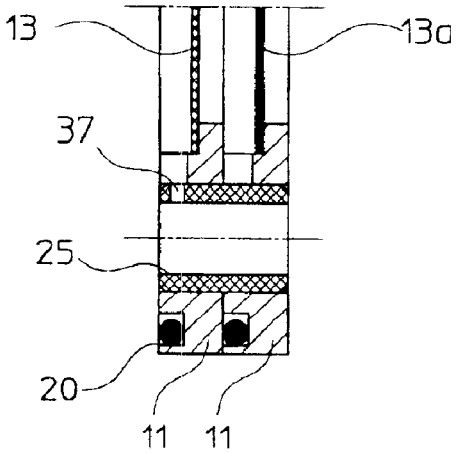
FIGS. 23 to 26 show alternative embodiments of the component in FIG. 3.
Figure 24:
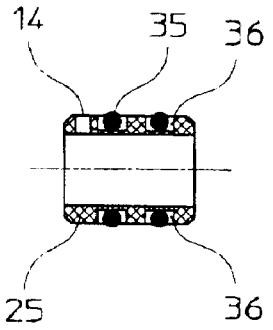
Figure 25:
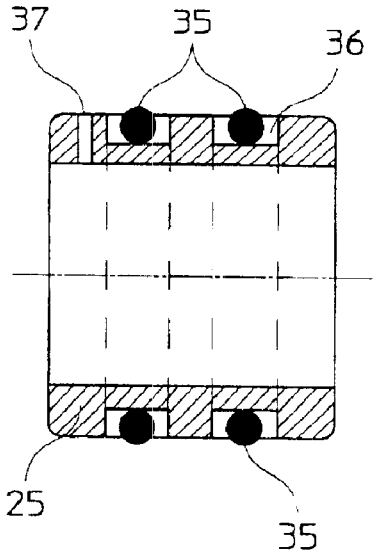
Figure 26:
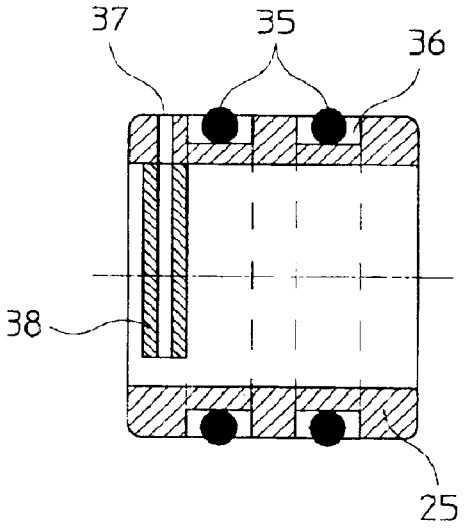

FIGS. 20 to 22 show a three compartment system (for example for fuel cells), alternating two compartment cells (two frames 11 with respective bipolar elements 31 and a frame 11 with separation element 31*a*), in which an electrolytic process takes place, and a single compartment 33, contained between two bipolar elements, where a heat exchange means is made to flow, to remove heat from or provide heat for said system. A collector, indicated by 34, arranged in the single compartment 33, can provide the electric continuity through it.

The invention thus conceived is susceptible to variations and modifications within the capabilities of a man skilled in the art. For example, with reference to FIGS. 23 to 26, the bushes can be externally equipped with one or more conventional sealing means 35, for example O-RINGS, housed into appropriate annular grooves 36. Or else, still said bushes can be equipped with one or more fluid passages 37, constituted by radial holes, rather than slits of the type previously described. Moreover, these bushes can be provided with tubular appendages 38, extended inside the bush and pointing towards respective fluid passages 37.

I claim:

1. A kit of modular components for the manufacture of an electrochemical reactor (1) of the filter-press type having a substantially tubular body (1*a*), closed at the opposite ends by end plates (2, 3) and in which is defined a sequence of electrolyte cells (4*a*, 4*b*) in fluid with pipes (7 to 10) extended in said body (1*a*), in a direction parallel to its axis (AA), for the collection and distribution of process fluids, said kit of components is characterized in that it comprises:

a plurality of electrochemically functional flat elements (13, 13*a*) selected from bipolar elements and separation elements, a plurality of frames (11), all identical to each other, realized with an electrically non-conducting material and structured to enclose and support inside them, respective pre-selected electrochemically functional flat elements (13, 13*a*), each of said frames (11) being equipped with an equal plurality of through-holes (14, 14*a*; 15, 15*a*; 21, 22; 26, 27) parallel to the axis of the respective frame (11) and equally angularly arranged between consecutive frames, each through-hole (14, 14*a*; 15, 15*a*; 21, 22; 26, 27) being in fluid communication with the inside of the frame (11) through at least one passage (16 to 19) extended in the respective frame (11) in a substantially radial direction;

a plurality of cylindrical bush inserts (25), obtained with an electrically non-conducting material, capable of being coaxially engaged in each of the through-holes (14, 14*a*; 15, 15*a*; 21, 22; 26, 27) in a pressurized fluid-tight arrangement, to hermetically close such at least one fluid communication passage (16 to 19) between the hole and the inside of the respective frame (11).

2. Kit of components according to claim 1, characterized in that said at least one passage (16, 19) is made up of a groove formed on the front of said frame (11), open at opposite ends onto said through-holes and the inside of said frame.

3. Kit of components according to claim 2, characterized in that said bush inserts (25) have a length equal to a multiple of the thickness of said frames (11) and are passed through by at least one fluid passage (26, 37), suitable for putting the through-holes in communication with the inside of the respective frames (11).

4. Kit of components according to claim 3, characterized in that said fluid passage of said bushes (25) is made up of a slit (26) formed radially on one end of the bushes themselves and having the same dimensions as said grooves (16, 19) formed on the front of said frames (11).

5. Kit of components according to claim 1, characterized in that said bush inserts (25) have a length equal to a multiple of the thickness of said frames (11) and are passed through by at least one fluid passage (26, 37), suitable for putting the through-holes in communication with the inside of the respective frames (11).

* * * * *